United States Patent [19]

Saito et al.

[11] 4,361,255

[45] Nov. 30, 1982

[54] ACCUMULATOR TYPE MANUAL ATOMIZER

[75] Inventors: Tadao Saito; Takao Kishi; Yoshiyuki Kakuta, all of Tokyo, Japan

[73] Assignee: Yoshino Kogyosho Co., Ltd., Tokyo, Japan

[21] Appl. No.: 347,498

[22] Filed: Feb. 10, 1982

Related U.S. Application Data

[63] Continuation-in-part of Ser. No. 134,186, Mar. 26, 1980, abandoned.

[30] Foreign Application Priority Data

Mar. 27, 1979 [JP] Japan ..... 54-35994
May 16, 1979 [JP] Japan ..... 54-66090

[51] Int. Cl.[3] ..... B65D 47/34

[52] U.S. Cl. ..... 222/321; 222/380; 222/382; 222/383

[58] Field of Search ..... 239/333; 222/321, 382, 222/383, 384, 385, 380, 378, 379, 381

[56] References Cited

U.S. PATENT DOCUMENTS

| | | | |
|---|---|---|---|
| 4,017,031 | 4/1977 | Kisi et al. | 222/321 X |
| 4,111,367 | 9/1978 | Hayes | 222/321 X |
| 4,162,746 | 7/1979 | Anderson et al. | 222/321 X |
| 4,179,049 | 12/1979 | Umstead | 222/321 X |

*Primary Examiner*—Allen N. Knowles
*Attorney, Agent, or Firm*—Stevens, Davis, Miller & Mosher

[57] ABSTRACT

An accumulator type, rechargeable atomizing spray mechanism having a container for liquid to be atomized, and further having an atomizer body, an atomizer head and an engaging member having a large-diameter hollow cylindrical portion. The atomizer has small and large diameter pistons formed into a piston member. The large diameter hollow cylindrical portion of an engaging member is surrounded by the peripheral wall of the atomizer head and has a rod portion extending downwards from its upper inside portion. Both pistons are respectively inserted into upper large diameter and lower small diameter cylindrical portions of the engaging member and atomizer body. The engaging member has a nozzle opening perforated at its large diameter cylindrical portion, which is normally closed by the large diameter piston of the piston member. A suction valve perforated at the bottom of the lower cylindrical portion of the atomizer body is closable by means of the rod-like valve body of the engaging member. Since the valve bodies are formed as part of the components of the atomizer, this atomizer can eliminate displacement of the ball valve used in conventional atomizers and can also provide an atomizer of simplified construction.

7 Claims, 4 Drawing Figures

ACCUMULATOR TYPE MANUAL ATOMIZER

CROSS REFERENCE TO RELATED APPLICATIONS

This application is a continuation-in-part of application Ser. No. 134,186 filed Mar. 26, 1980, now abandoned.

BACKGROUND OF THE INVENTION

1. Field of the Invention

The present invention relates to an atomizer and, more particularly, to an accumulator type manual atomizer for atomizing a liquid such as perfume, cosmetic preparations, etc. This atomizer is similar to the atomizer disclosed in application Ser. No. 146,394, filed May 5, 1980, a continuation of which (Ser. No. 320,005) was filed on Nov. 10, 1981. Both of these cases have now been abandoned. A continuation-in-part (Ser. No. 347,499) of the Nov. 10, 1981 continuation (Ser. No. 320,005) is co-pending with this application.

2. Description of the Prior Art

In the past, atomizers of this type have been proposed, but with complicated constructions and a large number of parts. These disadvantages led to difficulties in assembly, and also increased the likelihood of failure in performance.

SUMMARY OF THE INVENTION

It is an object of the present invention to provide an accumulator type manual atomizer eliminating the disadvantages of conventional atomizers discussed above.

It is a further object of this invention to provide an accumulator type manual atomizer which can be easily assembled with fewer components at a lower price.

A still further object of the present invention is to provide an accumulator type manual atomizer which eliminates the necessity of use of a ball valve, which can allow leakage of liquid when the container is tipped.

A still further object of the present invention is to provide an accumulator type manual atomizer which eliminates the possibility of loosing valve parts during assemblage.

The above-described objects and others will become more apparent and understandable by means of the following description and of the appended claims and the accompanying drawings.

DETAILED DESCRIPTION OF THE INVENTION

Figure 1:
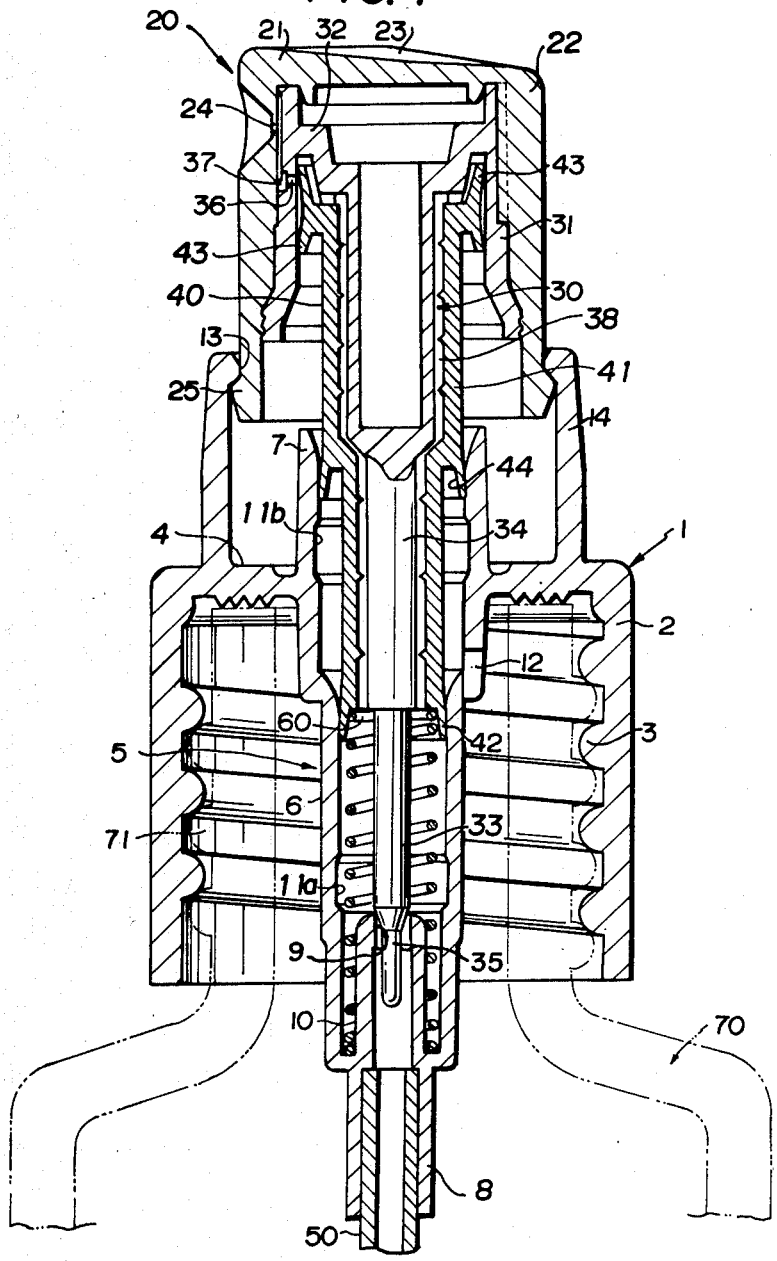
FIG. 1 shows a longitudinal section or elevation of a preferred embodiment of the upper portion of an accumulator type manual atomizer of the present invention.
Figure 2:
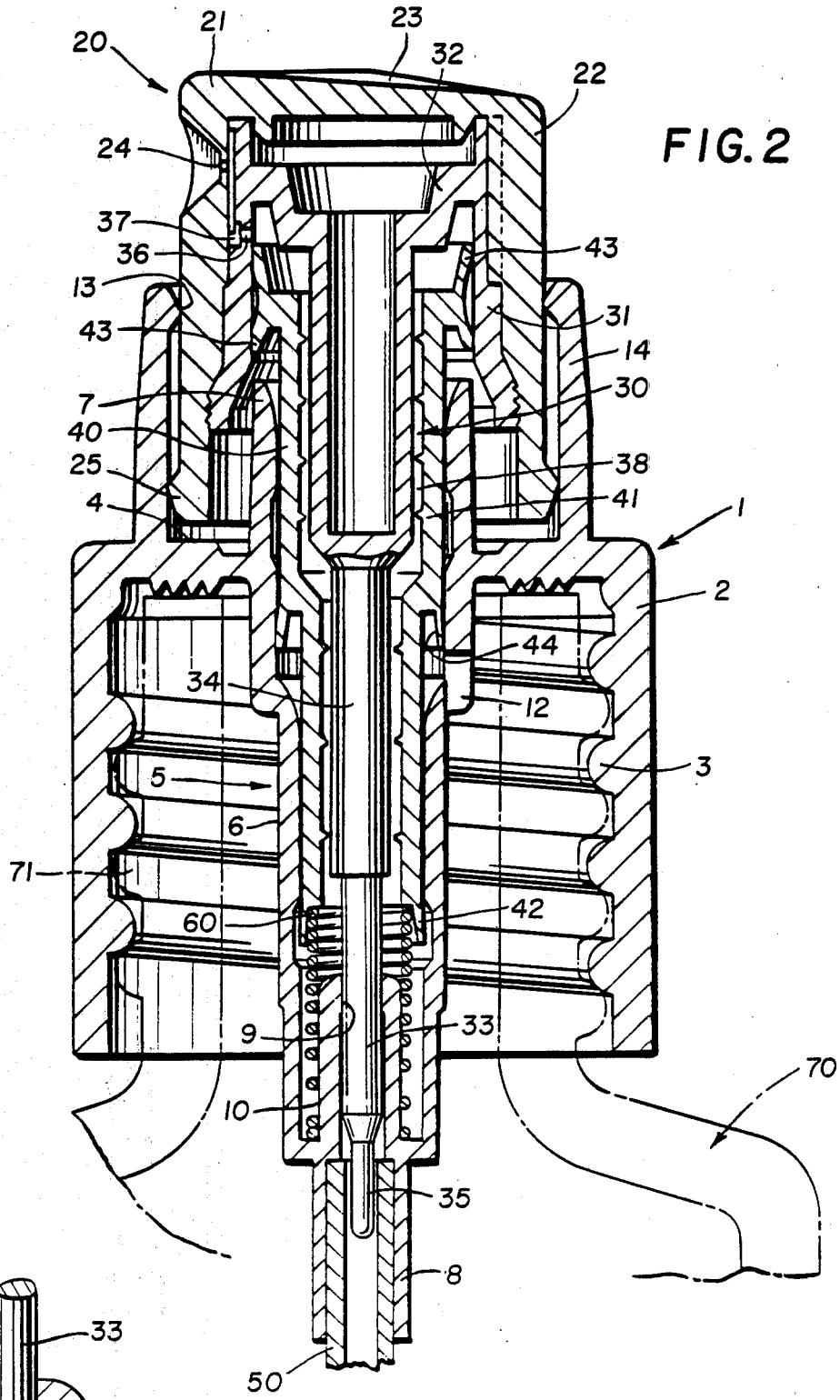
FIG. 2 shows the atomizer of FIG. 1 after the atomizer head has been depressed.
Figure 3:
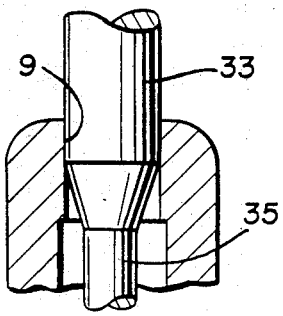
FIG. 3 shows a detailed view of the valve body and suction hole during operation.

Referring to FIGS. 1–3, the atomizer of the present invention basically utilizes an atomizer body 1, an atomizer head 20, an engaging member 30, a piston member 40, a suction tube 50, and a spring 60. The body 1 has an engaging peripheral wall 2 which can be provided with an internally threaded portion 3 to engage the neck portion of a container. A flange-like upper wall 4 extends radially inwardly from the peripheral wall. The main cylindrical portion 5 is formed from this upper wall 4, and has a lower, small-diameter hollow cylindrical portion 6 formed at the lower portion thereof, an upper, large-diameter hollow cylindrical guide portion 7 formed at the upper portion thereof and a cylindrical portion 8 suspended downwardly from the lower end of the lower cylindrical portion 6 for engaging the suction tube 50. As indicated above, the cylindrical guide portion 7 has an upper portion integrally protruded upwardly from the flange-like upper wall 4 and also has a lower portion integrally protruded downwardly from the wall 4. The peripheral wall 2 is formed so as to be coaxial with the main cylindrical portion 5. A suction valve hole 9 is provided at the inside bottom of the lower cylindrical portion 6. In the preferred embodiment, this valve hole 9 is formed so as to be perforated in the upper end of a hollow cylindrical portion 10 which extends upwardly from the lower end of the cylindrical portion 6.

Longitudinal annular recesses 11*a* and *b* are formed on the inner surfaces of lower cylindrical portion 6 and cylindrical guide portion 7, as can be seen in FIG. 1. A hole 12 is perforated at the connecting portion between the lower cylindrical portion 6 and the guide portion 7, as will be described later.

An engaging tubular portion 14 extends upwardly from the upper wall 4. This tubular portion is formed with an upper, annular, inwardly extending land 13 at its uppermost portion for retaining the atomizer head, as will be described later.

Referring to the atomizer head, there is provided a peripheral wall 22 which extends integrally from top wall 21, having a recess 23 to allow simple manipulation with a finger. A nozzle outlet 24 is formed in the upper side face of the wall 22. The peripheral wall 22 is provided with a lower, annularly outward land 25 at its lowermost portion to prevent the atomizer head 20 from being removed from the atomizer body. The atomizer head is elevationally movable with respect to the body, and more particularly to tubular portion 14.

An engaging member 30 is provided which has a large-diameter cylindrical portion 31 concentrically formed within and surrounded by the peripherial wall 22. A rod portion 34 extends downwardly from the connecting portion 32, which is attached to the large diameter portion 31. A rod-like valve body 33 extends downwardly from the rod portion 34.

The valve body 33 is engagable with the suction valve hole 9 of the cylindrical portion 10 and has a diameter which is close to that of the suction valve hole to water-tightly close the valve hole 9. Thus, the valve body 33 and the valve hole 9 form a suction valve. It is preferred that a guide extension 35 be provided at the end of the valve body 33 which has a diameter which is smaller than that of the valve hole 9. The large-diameter cylindrical portion 31 is provided with a nozzle opening 36 which is communicated with nozzle outlet 24. The nozzle opening 36 is normally closed by means of the large-diameter piston 43, as will be described in greater detail and communicates with nozzle outlet 24 through exhaust passage 37. This passage 37 may be constructed so as to spin liquid passing therethrough as is well known in the art.

The piston member 40 has a tubular portion 31 slidably engaged along the rod portion 34 of the engaging member 30, and is formed with a skirt-like small-diameter piston 42 at its lower end and a skirt-like large-diameter piston 43 at its upper end. The pistons 42 and 43 are surrounded by the small-diameter cylindrical portion 6 and the large-cylindrical portion 31 respectively. In the embodiment of FIG. 1, the tubular portion 41 has a small diameter at its lower portion and a large diameter at its upper portion along with a skirt-like intermediate-diameter piston 44 formed at the lower end of the upper portion. This piston 44 is surrounded by cylindrical guide portion 7. As can be seen in the drawings, a gap is formed between the inner surface of the tubular portion 41 and the outer surface of the rod portion 34, which allows communication between the small-diameter cylindrical portion 6 and the large-diameter cylindrical portion 31.

A liquid passage 38 is defined between the outer suface of the engaging member 30 and the inner surface of the piston member 40 so that liquid may pass from the container body into the passage 37 of the cylindrical portion 31. When the atomizer head 20 is depressed, liquid is introduced through passage 38 and passage 37 into the nozzle outlet 24 for atomization and expulsion through the outlet. The suction tube 50, which has its upper end engaged with cylindrical portion 8 preferably has a length so that its lower extremity reaches the bottom wall of the container.

A coil spring 60 is disposed between the main cylindrical portion 5 of the atomizer body 1 and the piston member 40 to urge the piston member, the engaging member 30 and the atomizer head 20 upwardly. In FIG. 1, the coil spring is disposed between the inside bottom surface of the small diameter portion 6 and the lower end of the tubular portion 41, but alternative arrangements could be provided.

The spring 60 urges the small-diameter piston 42 towards the uppermost end of the small-diameter cylindrical portion 6, the large-diameter piston 43 towards the uppermost end of the large-diameter cylindrical portion 31, and the intermediate-diameter piston 44 towards the uppermost end of the cylindrical guide portion 7, so that the land 25 of the atomizer head is engaged with the land 13 of the tubular portion 14. At this time, the suction valve formed by valve hole 9 and valve body 33 is open by having the valve body clear of the valve hole, while the exhaust valve formed by nozzle opening 36 and large-diameter piston 43 is closed.

It is of course intended that this atomizer be screwed onto the neck portion 71 of a container body 70, which is filled with liquid. Before the atomizer head is manually depressed for the first time against the tension of the spring 60, air is present with an accumulator chamber (which is defined by the large-diameter cylindrical portion 31, the small-diameter cylindrical portion 6 and the piston member 40). As the atomizer head is pushed downwards, valve hole 9 is closed by the valve body 33 (see FIG. 3) and thus closes the suction valve. Thus, as the head is depressed, the pressure in the accumulator chamber is gradually increased. This causes piston member 49 (which can be conveniently thought of as floating within the atomizer body) to be urged downwardly against the tension of the spring. This results from the increased pressure which builds up in the accumulator chamber and acts on the top of the piston member 40. Thus, the increased pressure in the accumulator chamber causes the piston member 40 to move downwardly with respect to the engaging member 30 due to the differences in diameters between the large and small-diameter cylindrical portions 31 and 6. The piston member 40 is urged downwardly until valve hole 36 is opened so as to be in communication with the accumulator chamber, thus opening the exhaust valve so as to exhaust air through the nozzle opening 24. As the pressure is relieved, the piston member 40 is again telescoped upwardly by the spring 60 to again close the exhaust valve 36. Once the small-diameter piston 42 reaches the longitudinal annular recess 11*a*, a passage can be formed between the accumulator chamber and the hole 12 to exhaust any residual pressure present in the accumulator chamber.

When the atomizer head 20 is released from manual depression, the piston member 40, the engaging member 30 and the head 20 are moved upwardly, basically as a single piece. This decreases the pressure in the accumulator chamber so that when suction valve 9 becomes open, liquid in the container body is sucked into the accumulator chamber through suction tube 50. At this point it should be noted that the length of member 33 may be varied to increase or decrease the amount of pressure accumulation, provided of course that at least some clearance is provided between the body 33 and the suction hole 9 when the atomizer head has returned to its uppermost position so that liquid may enter the accumulator chamber.

When the atomizer head is again depressed, compressed liquid is atomized through the nozzle outlet 24 in the same manner that compressed air was exhausted in the foregoing description. It should be noted that the provision of annular recess 11*b* allows formation of a passage between the outer surface of the piston member 40 and the inner surface of the cylindrical guide portion 7, which allows an influx of atmospheric air to enter the container body when the piston member 44 reaches the annular recess 11*b*. The air enters the container through hole 12. Thus, negative pressure within the container is prevented. It should also be noted that when the small diameter piston 42 reaches the annular recess 11*a*, as described above, the intermediate-diameter piston 44 has reached a position lower than the recess 11*b* which prevents residual pressure from passing between the cylindrical guide portion 7 and the piston member 40 and leaking upwardly.

Figure 4:
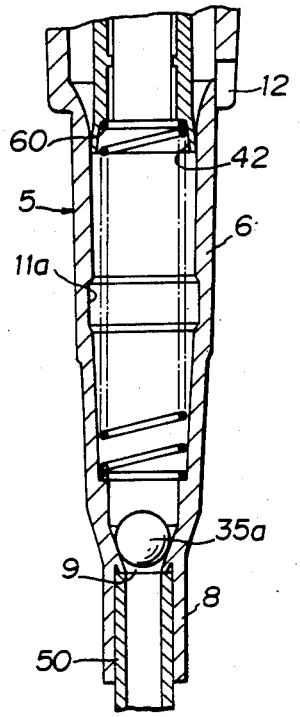
FIG. 4 shows an enlarged partially sectional elevation of another embodiment of the atomizer of the present invention.

In FIG. 4, another embodiment is shown. The atomizer of this embodiment incorporates a suction valve hole 9 which is closable by means of ball 35*a*. This replaces the valve hole 9 and rod-like valve body 33 of FIG. 1. The rest of the device would remain the same.

It can thus be seen that the present invention provides an atomizer of six essential parts, which are: atomizer body 1, atomizer head 20, engaging member 30, piston member 40, suction tube 50 and spring 60. This provides simple assembling and manufacture with corresponding cost decreases. The present invention can also eliminate the displacement of conventional ball valves in conventional atomizers when the atomizer is inclined, which could cause leakage of the liquid contained in the container. Furthermore, the present invention allows elimination of the possibility of losing the ball valve of the conventionl atomizer during manufacture, further simplifying the process of manufacture.

What is claimed is:

1. A liquid spraying device, comprising:

a container having a neck portion;

an atomizer body having a peripheral portion engaged with the neck portion of said container, a radially inwardly extending flange-like upper wall connected to the upper end of the engaging peripheral portion and a main cylindrical portion attached to said upper wall, having a small-diameter, hollow, lower cylindrical portion;

an atomizer head having a nozzle outlet preforated in said atomizer head, said head being slidable with respect to said atomizer body;

an engaging member having a large-diameter cylindrical portion which is held by said atomizer head, and having a rod portion downwardly extending from said large-diameter cylindrical portion, having a rod-lke valve body extending downwardly from said rod portion, said valve body being slidably inserted into the small diameter cylindrical portion of said atomizer bodies;

a piston member having a tubular portion which slidably engages the rod portion of said engaging member and which has a skirt-like small-diameter piston formed at the lower end of said piston member which is surrounded by the lower, small-diameter cylindrical portion of said atomizer body, and which has a skirt-like, large-diameter piston at the upper end of said piston member which is surrounded by the upper, large-diameter portion of said engaging member;

a suction tube which cooperates with the lower portion of the lower small-diameter, hollow cylindrical portion of said atomizer body for intaking liquid from said container; and spring means for upwardly urging said piston member, said engaging member and said atomizer head;

said atomizer body being provided with a suction valve hole at the inside bottom of the small-diameter cylindrical portion of said atomizer body, said engaging member having a nozzle opening formed in the large-diameter cylindrical portion of said engaging member in fluid communication with said nozzle outlet of said atomizer head, being normally closed by the large-diameter of said piston member; a liquid passage being defined between the outer surface of said engaging member and the inner surface of said piston member for communicating liquid from said container to said nozzle outlet of said atomizer head.

2. A liquid spraying device as claimed in claim 1, wherein said main cylindrical portion of said atomizer body further comprises an upper, large-diameter hollow cylindrical guide portion and a suction tube-engaging hollow cylindrical extending downwardly from the lower end of the lower, small-diameter cylindrical of said atomizer body.

3. A liquid spraying device as claimed in claim 1, wherein said suction hole is located at the upper end of a hollow cylindrical portion which extends upwardly from and is located radially inwardly from the small-diameter lower cylindrical portion of said atomizer body.

4. A liquid spraying device as claimed in claim 1 or 2, wherein the main cylindrical portion of said atomizer body further comprises a first longitudinal annular recess formed in the lower portion of said lower cylindrical portion of said atomizer body, a second annular recess formed in the upper portion of said main cylindrical portion of said atomizer body and a hole perforated at the junction between the upper and lower portions of main cylindrical portion.

5. A liquid spraying device as claimed in claim 1 wherein said engaging member further comprises an exhaust passage provided at the large-diameter cylindrical portion of said engaging member in fluid communication with the nozzle outlet of said atomizer head, being constructed so as to spin liquid which passes through said exhaust passage.

6. A liquid spraying as claimed in claim 1 or 2, wherein said piston member further comprises a skirt-like intermediate-diameter piston disposed between said large-diameter piston and said small-diameter piston and surrounded by the upper portion of said atomizer body.

7. A liquid spraying device comprising:

a container for liquid having a neck;

an atomizer body having a peripheral portion which engages the neck portion of said container, having a radially inwardly extending flange-like upper wall connected to the upper end of said peripheral portion, a main cylindrical portion attached to said upper wall, having a lower, small-diameter cylindrical portion which has a suction valve at the bottom of said small diameter cylindrical portion, which includes a suction valve hole and a ball valve;

an atomizer head having a nozzle outlet perforated in said atomizer, said atomizer head being slidable with respect to said atomizer body, an engaging member having a large-diameter hollow cylindrical portion which is held within said atomizer head, said engaging member having a rod portion extending downwardly from said large-diameter cylindrical portion;

a piston member having a tubular portion which slidably engages said rod portion of said engaging member, having a lower, skirt-like, small-diameter piston and an upper, skirt-like large-diameter piston, said small-diameter piston being surrounded by the small-diameter portion of said atomizer body and said large-diameter piston being surrounded by the large-diameter portion of said engaging member;

a suction tube engaged with the lower most portion of said small-diameter cylindrical portion of said atomizer body for intaking liquid from said container; and spring means for upwardly urging said piston member, said engaging member and said atomizer head;

said engaging member having a nozzle opening formed in the large-diameter cylindrical portion of said engaging member in fluid communication with the nozzle outlet of said atomizer head, and being normally closed by said large-diameter piston, a liquid passage being defined the outer surface of said engaging member and the inner surface of said piston member for communicating liquid from said container to the nozzle outlet of said atomizer head.

* * * * *